US006209629B1

(12) United States Patent
Halt et al.

(10) Patent No.: US 6,209,629 B1
(45) Date of Patent: Apr. 3, 2001

(54) BEADED PLATE FOR A HEAT EXCHANGER AND METHOD OF MAKING SAME

(75) Inventors: David Wayne Halt, Milford; Korey Vincent Parks, West Bloomfield; Ronald Richard Semel, Farmington, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/349,389

(22) Filed: Jul. 9, 1999

(51) Int. Cl.[7] ..... F28D 1/00
(52) U.S. Cl. ..... 165/148; 165/177
(58) Field of Search ..... 165/148, 153, 165/177, 166; 29/890.03

(56) References Cited

U.S. PATENT DOCUMENTS

| | | | | |
|---|---|---|---|---|
| 1,191,681 | * | 7/1916 | Feldkamp | 165/148 |
| 3,486,489 | | 12/1969 | Huggins . | |
| 4,600,053 | | 7/1986 | Patel et al. . | |
| 5,036,911 | * | 8/1991 | So et al. | 165/153 |
| 5,560,425 | * | 10/1996 | Sugawara et al. | 165/148 |
| 5,632,331 | * | 5/1997 | Shinmura | 165/153 |
| 5,638,897 | | 6/1997 | Hirano et al. . | |
| 6,012,511 | * | 1/2000 | Shinmura et al. | 165/133 |

FOREIGN PATENT DOCUMENTS

| | | |
|---|---|---|
| 3037873 | 3/1982 | (DE) . |
| 1271705 | 12/1963 | (FR) . |
| 2223091 | 3/1990 | (GB) . |
| 2000534 | 9/1993 | (RU) . |

* cited by examiner

*Primary Examiner*—Allen Flanigan
(74) *Attorney, Agent, or Firm*—Larry I. Shelton

(57) ABSTRACT

A beaded plate and method of making same for a heat exchanger includes a plate having a generally planar surface and a plurality of beads extending generally perpendicular to the surface of the plate. The beads are formed in a repeating pattern of non-aligned beads within a plurality of rows of the beads.

20 Claims, 1 Drawing Sheet

BEADED PLATE FOR A HEAT EXCHANGER AND METHOD OF MAKING SAME

BACKGROUND OF THE INVENTION

1. Field of the Invention

The present invention relates generally to heat exchangers for motor vehicles and, more specifically, to a beaded plate and method of making same for a heat exchanger in a motor vehicle.

2. Description of the Related Art

It is known to provide plates for a heat exchanger such as an oil cooler in a motor vehicle. Typically, opposed plates carry a first fluid medium in contact with an interior thereof while a second fluid medium contacts an exterior thereof. Typically, the first fluid medium is oil and the second fluid medium is air. Where a temperature difference exists between the first and second fluid mediums, heat will be transferred between the two via heat conductive walls of the plates.

It is also known to provide corrugated fins or ribs sandwiched between pairs of plates of a heat exchanger such as an oil cooler that act as a turbulator to increase the fluid side heat transfer coefficient while having to accept an appreciable amount of fluid side pressure drop. One known method of making such a construction is to physically insert a corrugated fin into the space between the plates after the plates have been manufactured. This is an extremely difficult process since the corrugated fin to be inserted between the plates is extremely thin and subject to deformation during the insertion process.

It is also known to provide beaded plates for a heat exchanger in which beads define a plurality of passageways between the plates for movement of a fluid therethrough to increase the surface area of conductive material available for heat transfer to cause turbulence of the fluid carried between the plates. An example of such a heat exchanger is disclosed in U.S. Pat. No. 4,600,053. In this patent, each of the plates has a plurality of beads formed thereon with one plate having one distinct variety of beads and the other plate having another distinct variety of beads. The beads of the plates contact each other and are bonded together to force fluid to flow therearound. The beads are aligned in rows in which one row has an "A" pattern and the adjacent or next row has a "B" pattern in which the beads are aligned with spaces of the A pattern. The rows are repeated in an AB pattern in which the beads in the A rows are aligned longitudinally or downstream with each other and the beads in the B rows are aligned longitudinally or downstream with each other.

Although the above heat exchangers have worked well, it is desirable to eliminate the use of a turbulator between the plates of a heat exchanger. It is also desirable to provide beaded plates for a heat exchanger having a repeating row pattern of non-aligned beads. It is still desirable to provide beaded plates for a heat exchanger that offer less resistance to flow than equal-sized turbulated heat exchangers with comparable heat rejection.

SUMMARY OF THE INVENTION

Accordingly, the present invention is a beaded plate for a heat exchanger including a plate having a generally planar surface and a plurality of beads extending generally perpendicular to the surface of the plate. The beads are formed in a repeating pattern of non-aligned beads within a plurality of rows of the beads.

Also, the present invention is a method of making a beaded plate for a heat exchanger. The method includes the steps of providing a plate having a generally planar surface and forming a plurality of beads generally perpendicular to the surface of the plate in a repeating pattern of non-aligned beads within a plurality of rows of the beads.

One advantage of the present invention is that a beaded plate for a heat exchanger such as an oil cooler is provided for a motor vehicle for cooling liquid oil. Another advantage of the present invention is that the beaded plate eliminates the need for a separate turbulator between plates for a heat exchanger such as an oil cooler. Yet another advantage of the present invention is that the beaded plate has a repeating pattern of non-aligned beads within a number of rows of the beads. Still another advantage of the present invention is that the beaded plate offers less resistance to flow than equal-sized turbulated oil coolers with comparable heat rejection. A further advantage of the present invention is that a method of making a beaded plate for an oil cooler is provided which uses less material, parts and complexity for assembly. Yet a further advantage of the present invention is that the beaded plate more evenly distributes the enhanced heat transfer and mixing along the depth of the plate than occurs with more traditional alignments of rows and columns of beads.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
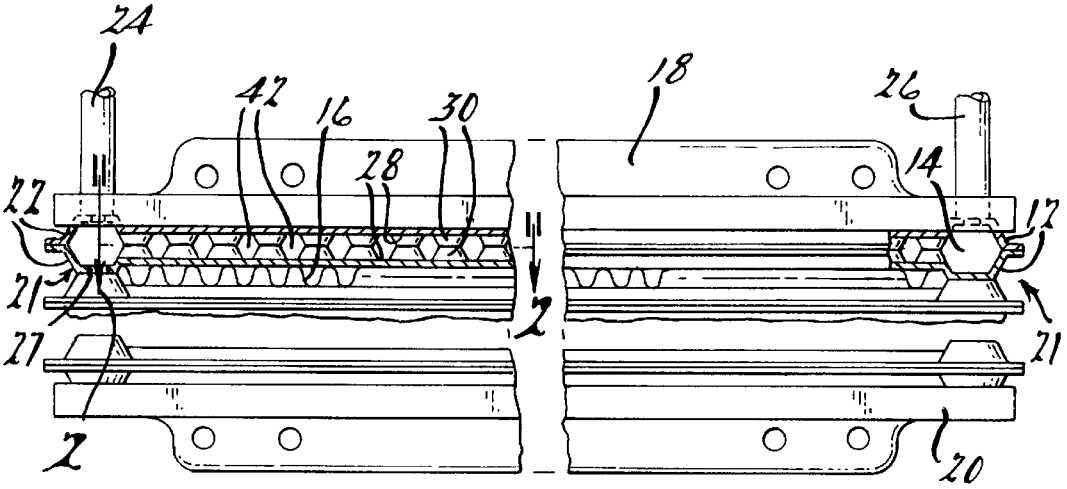
FIG. 1 is a fragmentary elevational view of a beaded plate, according to the present invention, illustrated in operational relationship with a heat exchanger for a motor vehicle.

Referring to the drawings and in particular FIG. 1, one embodiment of a heat exchanger 10, according to the present invention, such as an oil cooler, evaporator or condenser, is shown for a motor vehicle (not shown). The heat exchanger 10 includes a plurality of generally parallel beaded plates 12, according to the present invention, pairs of which are joined together in a face-to-face relationship to provide a channel 14 therebetween. The heat exchanger 10 also includes a plurality of convoluted or serpentine fins 16 attached an exterior of each of the beaded plates 12. The fins 16 are disposed between each pair of the joined beaded plates 12 to form a stack. The fins 16 serve as a means for conducting heat away from the beaded plates 12 while providing additional surface area for convective heat transfer by air flowing over the heat exchanger 10. The heat exchanger 10 further includes oppositely disposed first and second mounting plates 18 and 20 at ends of the stack. The mounting plates 18,20 fluidly communicate with flow headers, generally indicated at 21, formed by bosses 22 on each of the beaded plates 12. The heat exchanger 10 includes a fluid inlet 24 for conducting fluid into the heat exchanger 10 formed in the first mounting plate 18 and an outlet 26 for directing fluid out of the heat exchanger 10 formed in the second mounting plate 18. It should be appreciated that, except for the beaded plates 12, the heat exchanger 10 is conventional and known in the art. It should also be appreciated that the beaded plates 12 could be used for heat exchangers in other applications besides motor vehicles.

Figure 2:
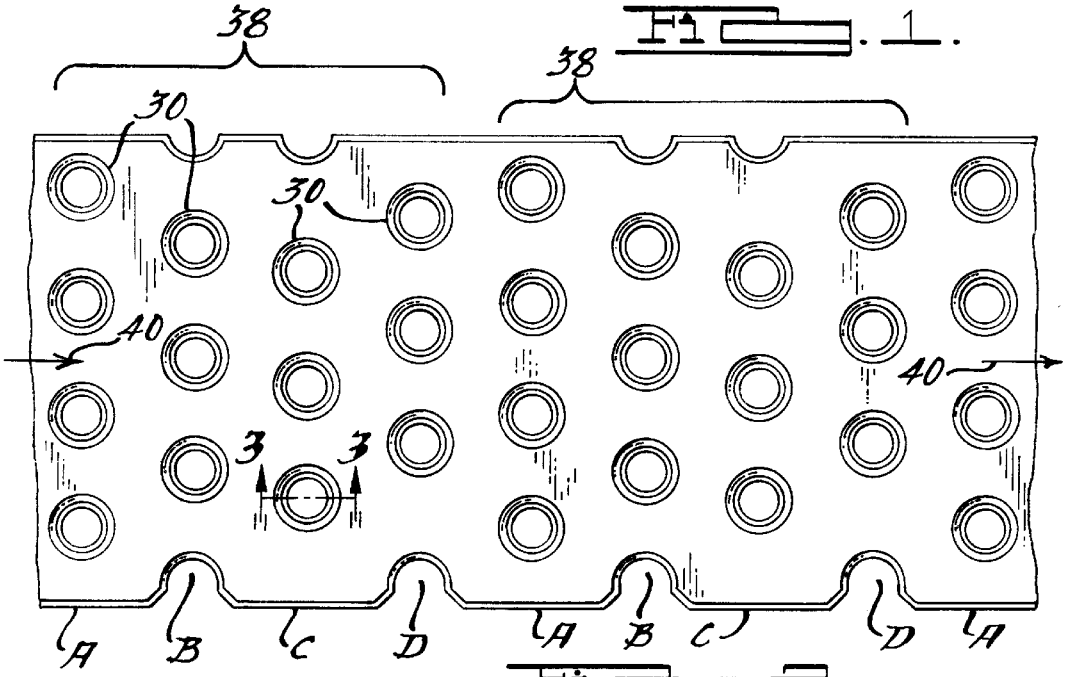
FIG. 2 is a sectional view taken along line 2—2 of FIG. 1.
Figure 3:
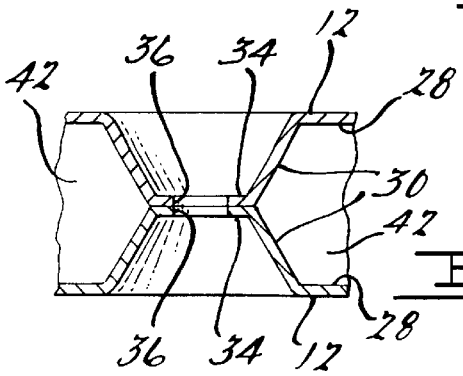
FIG. 3 is a sectional view taken along line 3—3 of FIG. 2.

Referring to FIGS. 1 through 3, the beaded plate 12 extends longitudinally and is substantially planar or flat. The beaded plate 12 includes a raised boss 22 on each end having an aperture 27 extending therethrough. The bosses 22 are stacked together such that the apertures 27 are aligned to form the flow header 21 to allow parallel flow of fluid through the channels 14 of the beaded plates 12. It should be appreciated that such flow headers 21 are conventional and known in the art.

The beaded plate 12 includes a surface 28 being generally planar and extending longitudinally and laterally. The beaded plate 12 also includes a plurality of beads 30 extending above and generally perpendicular to a plane of the surface 28 and spaced laterally from each other. The beads 30 are generally circular in shape and have a predetermined diameter such as three millimeters. The beads 30 have a side wall 32 extending at an angle to the surface 28 from a larger diameter to a smaller diameter that terminates in a generally planar end wall 34. The end wall 34 forms a predetermined diameter such as 1.5 millimeters and has an aperture 36 extending therethrough. It should be appreciated that the beads 30 have a generally frusto-conical cross-sectional shape.

As illustrated in FIG. 2, the beads 30 are formed in a pattern 38 of a plurality of rows, at least three rows in the pattern 38, preferably four rows A,B,C,D, in the pattern 38, which is repeated. Each row A,B,C,D contains a plurality of, preferably a predetermined number of beads 30 in a range of two to eleven. The rows A,B,C,D of beads 30 are spaced longitudinally a predetermined distance such as approximately 2.45 millimeters. The beads 30 in the rows A,B,C,D are located laterally so that no bead 30 is directly downstream of another bead 30 within the pattern 38. The beads 30 in the pattern 38 are non-aligned in the streamwise or longitudinal direction as indicated by the arrows 40. The pattern 38 is repeated in the streamwise or longitudinal direction as indicated by the arrows 40. It should be appreciated that a row A,B,C,D could contain all full beads 30 or full and half beads 30.

The beaded plate 12 is made of a metal material such as aluminum or an alloy thereof and has a cladding on its inner and outer surfaces for brazing. In the embodiment illustrated, a pair of the beaded plates 12 is arranged such that the end walls 34 of the beads 30 contact each other to form a plurality of flow passages 42 in the channel 14 as illustrated in FIGS. 1 and 3. The beads 30 turbulate fluid flow through the channel 32. It should be appreciated that the end walls 34 of the beads 30 are brazed to each other. It should also be appreciated that the entire heat exchanger 10 is brazed together as is known in the art.

Referring to FIGS. 1 through 3, a method of making the beaded plate 12, according to the present invention, is shown. The method includes the step of providing a plate 12 having a generally planar surface 28. The method includes the step of forming a plurality of beads 30 to extend above the surface 28 of the plate 12 in a repeating pattern 38 of non-aligned beads 30 within a plurality of rows A,B,C,D in the pattern 38 as illustrated in FIG. 2. The step of forming is carried out by stamping the beads 30 in the plate 12 by conventional stamping processes.

Also, a method of making the heat exchanger 10, according to the present invention, is shown. The method includes the step of contacting first and second beaded plates 12 with each other to form the channel 14 therebetween and contact opposed beads 30 with each other to form the fluid flow passages 42 as illustrated in FIGS. 1 and 3. The method includes the step of brazing a pair of the beaded plates 12 by heating the beaded plates 12 to a predetermined temperature to melt the brazing material to braze the bosses 22 and the beads 30 of the beaded plates 12 together. The pair of joined beaded plates 12 is then cooled to solidify the molten braze material to secure the bosses 22 together and the beads 30 together. The method includes the step of disposing fins 16 between joined pairs of the beaded plates 12 and brazing the fins 16 and beaded plates 12 together. The method includes the steps of connecting the first and second mounting plates 18 and 20 to the brazed fins 16 and beaded plates 12 to form the heat exchanger 10.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A beaded plate for a heat exchanger comprising:

a plate having a generally planar surface; and a plurality of beads extending generally perpendicular to said surface of said plate, wherein said beads are formed in a repeating pattern of at least three rows, wherein said beads within said rows are located laterally so that no bead is directly downstream of another bead within said pattern such that said beads in said pattern are non-aligned in a longitudinal direction.

2. A beaded plate as set forth in claim 1 wherein said pattern includes at least three of said rows.

3. A beaded plate as set forth in claim 1 wherein said pattern includes four of said rows.

4. A beaded plate as set forth in claim 1 wherein said beads are generally circular in shape.

5. A beaded plate as set forth in claim 1 wherein each of said rows includes from two to eleven of said beads.

6. A heat exchanger comprising:

a plurality of generally parallel plates, pairs of said plates being joined together in a face-to-face relationship to provide a channel therebetween, the pairs of said plates being joined together and aligned in a stack;

a plurality of fins attached to an exterior of said plates and disposed between each pair of said joined plates; and said plates including a plurality of beads spaced laterally and opposing each other in said channel and being formed in a repeating pattern of at least three rows, wherein said beads within said rows are located laterally so that no bead is directly downstream of another bead within said pattern such that said beads in said pattern are non-aligned in a longitudinal direction.

7. A heat exchanger as set forth in claim 6 wherein said pattern includes at least three of said rows.

8. A heat exchanger as set forth in claim 6 wherein said pattern includes four of said rows.

9. A heat exchanger as set forth in claim 6 wherein said beads are generally circular in shape.

10. A heat exchanger as set forth in claim 6 wherein each of said rows includes from two to eleven of said beads.

11. A method of making a beaded plate for a heat exchanger comprising the steps of:

providing a plate having a generally planar surface; and forming a plurality of beads to extend generally perpendicular to the surface of the plate in a repeating pattern of at least three rows, wherein said beads within said rows are located laterally so that no bead is directly downstream of another bead within said pattern such that said beads in said pattern are non-aligned in a longitudinal direction.

12. A method as set forth in claim 11 wherein said step of forming comprises forming at least three rows of beads in a pattern.

13. A method as set forth in claim 11 wherein said step of forming comprises forming four rows of beads in a pattern.

14. A method as set forth in claim 11 wherein said step of forming comprises forming from two to eleven beads in a row.

15. A method as set forth in claim 11 wherein said step of forming comprises forming the beads with a generally circular cross-sectional shape.

16. A method of making a heat exchanger comprising the steps of:

providing a plurality of generally parallel plates including a plurality of beads being formed in a repeating pattern of at least three rows, wherein the beads within the rows are located laterally so that no bead is directly downstream of another bead within the pattern such that the beads in the pattern are non-aligned in a longitudinal direction, pairs of the plates being joined together in a face-to-face relationship to provide a channel therebetween, the pairs of the plates being joined together and aligned in a stack;

providing a plurality of fins to be attached to an exterior of the plates and disposing the fins between each pair of the joined plates; and joining the fins and pairs of joined plates together to form the heat exchanger.

17. A method as set forth in claim 16 wherein said step of providing the plurality of generally parallel plates includes the step of forming the beads with a generally circular shape.

18. A method as set forth in claim 17 wherein said step of providing the plurality of generally parallel plates includes the step of stamping the beads in the plates.

19. A method as set forth in claim 17 including the step of contacting opposed beads with each other to form fluid flow passages in the channel.

20. A method as set forth in claim 17 wherein said step of joining comprises brazing the plates and fins together.

* * * * *